US011517921B2

(12) United States Patent
Mock et al.

(10) Patent No.: US 11,517,921 B2
(45) Date of Patent: Dec. 6, 2022

(54) CARTRIDGE, METHOD FOR OPERATING THE CARTRIDGE, WATER NOZZLE INSERT AND OUTLET

(71) Applicant: GJOSA SA, Biel/Bienne (CH)

(72) Inventors: Elmar Mock, Salvan (CH); Max Rousselet, Prêles (CH)

(73) Assignee: GJOSA SA, Biel/Bienne (CH)

( * ) Notice: Subject to any disclaimer, the term of this patent is extended or adjusted under 35 U.S.C. 154(b) by 50 days.

(21) Appl. No.: 15/734,704

(22) PCT Filed: Jun. 3, 2019

(86) PCT No.: PCT/EP2019/064372

§ 371 (c)(1),
(2) Date: Dec. 3, 2020

(87) PCT Pub. No.: WO2019/233958

PCT Pub. Date: Dec. 12, 2019

(65) Prior Publication Data

US 2021/0220847 A1 Jul. 22, 2021

(30) Foreign Application Priority Data

Jun. 4, 2018 (EP) ..... 18175835

(51) Int. Cl.
*B05B 1/26* (2006.01)
*B05B 15/65* (2018.01)
*B05B 15/18* (2018.01)

(52) U.S. Cl.
CPC ..... *B05B 1/26* (2013.01); *B05B 15/65* (2018.02); *B05B 15/18* (2018.02)

(58) Field of Classification Search
CPC ..... B05B 1/26; B05B 15/65; B05B 15/18
USPC ..... 239/543, 544, 589, 600
See application file for complete search history.

(56) References Cited

U.S. PATENT DOCUMENTS 2,605,144 A 7/1952 Northup
2,744,738 A 5/1956 Hjulian
6,322,008 B1 * 11/2001 Aker ..... B05B 1/26 239/543
7,219,849 B1 5/2007 Hedger
(Continued)

FOREIGN PATENT DOCUMENTS

AU 2011239349 11/2011
BE 514104 9/1952
(Continued)

OTHER PUBLICATIONS

Subject Search on "Water nozzle insert and outlet", Feb. 28, 2019, Swiss Federal Institute of Intellectual Property, p-search@ipi.ch / www.ip.search.ch, 63 pages.

*Primary Examiner* — Steven J Ganey
(74) *Attorney, Agent, or Firm* — Rankin, Hill & Clark LLP

(57) ABSTRACT

A cartridge for use in a showerhead or tap is designed for dispensing a liquid, in particular water or a water-based mixture. The cartridge comprises a set of at least two nozzles arranged to create colliding jets of the liquid and thereby create a spray of droplets of the liquid, and a spray shaper for guiding the spray. An inner diameter of the nozzles is between 0.8 and 1.5 millimetres, and a throat of each of the nozzles, along which the nozzle has a constant diameter, has a length that is at least three times this inner diameter.

26 Claims, 3 Drawing Sheets

(56) References Cited

U.S. PATENT DOCUMENTS

| | | | |
|---|---|---|---|
| 7,278,591 | B2 | 10/2007 | Clearman et al. |
| 8,458,826 | B2 | 6/2013 | Mock et al. |
| 2004/0016834 | A1 | 1/2004 | Casalmir et al. |
| 2013/0118538 | A1 | 5/2013 | Zhou et al. |
| 2018/0043377 | A1* | 2/2018 | Xu ..... B05B 1/185 |

FOREIGN PATENT DOCUMENTS

| | | |
|---|---|---|
| DE | 10 2006 058 756 | 1/2008 |
| DE | 20 2013 002 283 | 6/2014 |
| EP | 1 391 246 | 2/2004 |
| EP | 1 795 221 | 6/2007 |
| EP | 2 907 431 | 8/2015 |
| JP | H02-91654 | 7/1990 |
| JP | H07-20405 | 4/1995 |
| JP | 2012-082591 | 4/2012 |
| WO | 97/11784 | 4/1997 |
| WO | 2004/101163 | 11/2004 |
| WO | 2007/062536 | 6/2007 |
| WO | 2009/126987 | 10/2009 |
| WO | 2011/054120 | 5/2011 |
| WO | 2013/139811 | 9/2013 |

* cited by examiner

CARTRIDGE, METHOD FOR OPERATING THE CARTRIDGE, WATER NOZZLE INSERT AND OUTLET

BACKGROUND OF THE INVENTION

Field of the Invention

The invention relates to a cartridge, method for operating the cartridge, water nozzle insert and outlet, for use in an outlet for spraying a liquid such as water or a water-based mixture, for example in a washing installation as used in the field of domestic plumbing installations.

Description of Related Art

WO 2004/101163 A1 discloses a showerhead with a large number of nozzle pairs, each nozzle pair creating impinging jets of water with the goal of creating a spray of water. The showerhead is supposed to operate well over a range of pressures.

BE 514104A discloses a spray head with colliding water jets created by four inclined holes in in a flat plate, at an angle of 45°. The thickness of the plate is 1 to 5 mm. The diameter of the holes is said to be smaller than nozzle 12 mm.

U.S. Pat. No. 2,744,738 discloses an aerator with colliding water jets, including flow guiding elements after the point of collision.

U.S. Pat. No. 7,278,591 discloses a showerhead with a plurality of tubes for dispensing water. A turbine driven by the water moves the tubes such that they change direction and also the direction of water dispensed from each tube.

JP H07 20405 U discloses a mouthpiece for a spout used for a faucet, which sprays water at an angle that deviates from a right angle to the flow in the faucet.

JP H02 91654 U discloses a water spraying plate in a showerhead, the plate comprising, instead of a large number of water outlet openings, a smaller number of openings that create colliding jets of water.

U.S. Pat. No. 8,458,826, also published as AU 2011/239349 A1 discloses an outlet for a shower or tap wherein water is dispensed at a low flow rate and at a high pressure, typically more than 10 bar, through impinging jets. As opposed to WO 2004/101163 A1 cited above, only one or two nozzle pairs are sufficient for an outlet in a showerhead. A good washing experience, that is, a feeling of a full water flow and good rinsing in spite of the low flow rate, is obtained by atomisation of the water by means of the colliding jets, which in turn is a result of the high pressure.

WO 2011/054120 A1 discloses, for example in embodiments according to FIGS. 4 to 6 and FIGS. 20 to 23, cartridges for generating a spray of a liquid, such as water or water-based mixture, from colliding jets. Such cartridges can be integrated units for atomising and spraying such a liquid a water-based mixture, by means of impinging jets of the liquid under high pressure.

Such a prior art cartridge 8 is shown in FIG. 1. It can be assembled from separate parts, which are joined together in a preferably non-separable manner, for example by welding and/or molding and/or glueing and/or snap connections. The main nozzle set body 9 or cartridge body is preferably made of a plastic material. The cartridge 8 is designed to withstand the high pressures required by the atomising principle, plus a margin of safety.

The atomised spray is created by impinging jets of liquid that flow from nozzles 29. The nozzles 29 are defined by or made in nozzle inserts 10 arranged in the cartridge body 9. In other embodiments, the nozzles 29 are shaped in the cartridge body 9 itself, without separate nozzle inserts. The spray created is an initial spray 13, inside the cartridge 8, which can pass through an obstruction element 24, in particular a sieve or mesh or perforated plate, and forms an outer spray 23 that leaves the cartridge 8 at an outlet opening.

From the cartridge inlet 35, the liquid flows first into a prechamber 5, then around a diversion element 38 and through a diversion passage 39 into an intermediate chamber 12, from which it enters the nozzles 29. The diversion element 38 forces the liquid first to flow in a direction opposite to the direction to the nozzles 29, and also around the diversion element 38, evening out the flow.

The cartridge 8 can include a cover piece, a piece including the diversion element 38, a piece including the nozzle insert(s) 10 and the spray shaper 14 and the mesh, all made of a polymer (plastic) and welded together. Exemplary dimensions of the cartridge 8 are the following: height: 31 mm, of which 14 mm are for the inner spray shaper and the nozzles, and 17 mm are for the diversion element and the cover piece. The nozzles stand at a 90° angle to one another. The impinging point lies at least 4 mm, e.g., at 4.7 mm, from the outlet or outflow of each nozzle. Increasing this distance reduces the noise created by the impinging jets. For this reason, the outlets of the nozzles are preferably arranged each in a preferably separate recess in the inner spray shaper, that is, behind the surface of the inner spray shaper 14 and not at the surface of the inner spray shaper. Consequently, after exiting the nozzle, a jet of water flies freely along the recess, then exits the inner wall 15 of the inner spray shaper 14 and then flies inside the free volume of the cavity of the inner spray shaper 14 until it hits the other jet or jets. Arranging the nozzle outlets at the inner end of a recess in the inner wall 15 increases the length of the freely flying jet (as compared to a nozzle outlet at the level of the inner wall 15).

The nozzles are made of ceramic or polymer or metal and are preferably inserted, that is driven in without glue in the cartridge body. Alternatively, they are arranged in the cartridge by insertion moulding. The diameter of the nozzles ranges from 0.4 mm to 0.8 mm and preferably 0.55 mm and 0.65 mm and is preferably 0.58 mm or 0.61 mm. The noise of the impinging jets can be reduced by reducing the nozzle diameter. In order to maintain a desired flow rate of water, the number of impinging jets can be increased accordingly. There may be several jets impinging on the same point, or two or more subsets of jets impinging at different points in the same cavity.

Existing devices using impinging jets of water for generating a spray of water, in particular for application to the human body, either exhibit a water flow that is too large to be considered water saving, or require a pump for increasing the water pressure.

There is a need to simplify the construction and operation of a nozzle arrangement for generating a spray of water, in particular for applications to the human body.

SUMMARY OF THE INVENTION

The following terms shall be used: An outlet includes one or more atomisers. An atomiser includes, for example, a nozzle set with two or more nozzles for creating impinging jets of water. As opposed to sprayers ordinarily used in showers, an atomiser generates a flow of a mixture of air and microscopic water droplets rather than macroscopic drops.

An outlet can be a part of a tap, or can be a shower head attached to a handle, or a shower head fixedly installed at the end of a pipe or sunk in a wall. An outlet thus is a unit that can be transported, handled and installed as a single unit, in contrast to a shower installation: A shower installation may include more than one shower heads, arranged, for example, at the top of and in side walls of a shower cabin, with additional plumbing providing the shower heads with pressurised water.

It is an object of the invention to improve over existing devices, in particular over a cartridge, method for operating the cartridge, water nozzle insert and outlet of the type mentioned initially, for use in a washing device in a domestic plumbing installation or in a portable shower or hand washing unit, overcoming the disadvantages mentioned above.

These objects are achieved by a cartridge, method for operating the cartridge, water nozzle insert and outlet according to the corresponding claims.

The cartridge for use in a showerhead or tap is designed for dispensing a liquid, in particular water or a water-based mixture. It includes a set of at least two, in particular exactly two, nozzles arranged to create colliding jets of the liquid and thereby create a spray of droplets of the liquid, and a spray shaper for guiding the spray.

Therein, an inner diameter of the nozzles is between 0.8 and 1.5 millimetres, and a throat of each of the nozzles, along which the nozzle has a constant diameter, has a second length that is at least three times this inner diameter.

In embodiments, the inner diameter is between 0.8 and 2 millimetres.

In embodiments, a radius (Re) of an edge forming a transition between the inner surface of the nozzles and the inner surface of the spray shaper is less than two or less than one or less than 0.8 or less than 0.5 or less than 0.3 millimetres.

Such a small radius prevents the jet of water exiting the nozzle from following, due to adhesion to the nozzle walls, the surface of the nozzle and being spread out.

In embodiments, a distance between a collision point, at which the jets collide, and front surface is three to four times, or five to nine times, in particular six to eight times, in particular seven times a distance between nozzle outlets and a point at which the jets collide.

In absolute terms, this distance between nozzle outlets and a point at which the jets collide can be between 1 and 7 millimetres.

A distance between centres of the nozzle outlets can be between 2 and 7, in particular between 4 and 5 millimetres.

In contrast to U.S. Pat. No. 8,458,826 and WO 2011/054120 A1 mentioned above, by the same applicant, the applicant has come to the surprising finding, that by adapting the design of the cartridge and in particular the nozzles, it is possible to achieve the same results regarding a good washing experience—that is, the feeling of a full flow of water and good rinsing—at a low flow rate but without increasing the pressure prior to dispensing the water or water based mixture.

This becomes possible by means of the features of the present invention. The various measures realised by these features are directed to reduce losses in the energy carried by the liquid by turbulence and diversions, which in turn can be caused by obstructions in the path of the flow, non-laminar flow and by adhesion.

In embodiments, the diameter of the nozzles is such that, at a typical mains pressure, a desired flow rate is obtained with a minimum of nozzle sets, in particular with a single nozzle set having exactly two nozzles. As a result, the total loss of energy in the flow—which occurs mainly in the nozzles—is kept small, e.g. as compared to outlets having a plurality of nozzle sets with narrower nozzles and achieving the same flow rate. Thus, more of the energy contained in the pressure of the liquid at the entrance of the nozzles can be transferred into kinetic energy of the water jets, and this in turn improves the atomization of the water. That is, the more kinetic energy is in the water jets, the smaller are the droplets that are generated by the collision. This has been shown to improve the washing experience.

For situations where there is no water supply with a minimum (mains) pressure, a pump can be used. The pump can be designed to provide the minimum and constant pressure at the desired low flow rate.

In embodiments, the spray shaper has the shape of a hollow cylinder. In embodiments, the hollow space constituting the spray shaper is wider near the front surface than near the nozzles. In embodiments, the hollow space is constricted at some points of its circumference, giving it, for example, a transverse cross section in the shape of the numeral "8".

In embodiments, the spray shaper is, free from obstacles, such as sieves, channels, . . . etc.

The cartridge can be applied to uses in hair care, with or without an additive such as soap being added to the water. If soap is added, the impacting jets provide an advantageous mixing of the water, soap and air. The cartridge can be applied to uses in cleaning and rinsing objects, e.g., in a kitchen.

In embodiments, the cartridge is free from filters.

In embodiments, the cartridge is free from elements that reverse a flow of liquid in the cartridge.

This reduces the loss of energy in the flow of water, increasing the speed and energy of the colliding jets. This can increase the quality of the spray generated by the colliding jets (e.g., by creating smaller droplets), In embodiments, the nozzles are arranged for the jets of liquid to collide at an angle between 70° and 110°, in particular between 80° and 100°, in particular 90°.

In embodiments, a distance between a point at which the jets collide and a spray shaper back end lies between 2 and 7, in particular between 3 and 5, in particular between 3 and 4 millimetres.

The spray shaper back end lies at the back of the spray shaper, at maximum distance from the spray shaper front end.

In embodiments, an angle at which the nozzles exit at an inner surface of the spray shaper (at a spray shaper back end) is more than 70°, in particular more than 80° and in particular equal to 90°.

This reduces—compared to smaller angles—disturbance of the flow by an asymmetric nozzle outlet.

In embodiments, at an edge forming a transition between the inner surface of the nozzles and the surface of the spray shaper forms an acute angle, in particular an angle of less than 85° or less than 80° or less than 75°.

In embodiments, the inner surface of the spray shaper is cylindrical.

In embodiments, the cartridge includes a skirt in which the spray shaper is arranged. The skirt can be ring-like, such as a section of a pipe. It can be an essentially cylindrical part. "Cylindrical" can refer to a generalised but right cylinder, or to a right circular cylinder. The inside of the skirt, constituting an inner surface of the spray shaper, can be a right circular cylinder, while the outside of the skirt can be a right circular or non-circular cylinder, or another shape.

In embodiments, the entirety of elements acting as spray shaper are part of the cartridge itself.

In embodiments, the spray shaper, at an outer end of the spray shaper opposite to the spray shaper back end, ends with a flow guiding edge forming an acute angle (Phi1) between an inner surface of the spray shaper and an adjacent, intermediate surface, in particular an angle of less than 85° or less than 80° or less than 75°.

In embodiments, a radius (Rf) of the flow guiding edge is less than two or less than one or less than 0.8 or less than 0.5 or less than 0.3 millimetres.

This radius can be implemented by the edge having an at least approximately circular shape, with this radius being an average radius, when seen in a cross section. The cross section is in planes including the longitudinal axis of symmetry of the spray shaper. Given a rotational symmetry of the spray shaper around this axis, the cross section is essentially the same in all such planes. This radius can also be implemented by the edge, in such a cross section, being shaped with a flat section between the inner surface and the intermediate surface, with the flat section extending for a length according to this radius.

In embodiments, the intermediate surface, beginning at the flow guiding edge, extends in the direction of the spray shaper back end, and then again in the opposite direction, passing into a front surface of the cartridge, In embodiments, a radial distance (dR) between the flow guiding edge and a point at which the intermediate surface passes into the front surface is at least three millimetres, in particular at least four millimetres, in particular at least five millimetres.

This distance prevents water from flowing into the volume defined by the intermediate surface by capillary effects, and accumulating there.

In embodiments, the front surface is distanced from the spray shaper back end more than the flow guiding edge is.

In other words, relative to the front surface, the flow guiding edge is recessed. This protects the flow guiding edge from mechanical damage.

In embodiments, when seen in a longitudinal section of the cartridge, an angle between the intermediate surface, in a region in which the intermediate surface runs towards the front surface, is an obtuse angle. In particular, the angle is more than 100°, in particular more than 110°.

In embodiments, the spray shaper, including the skirt and the flow guiding edge, is integrally shaped as part of the skirt.

In embodiments, the cartridge is fabricated in one piece or is fabricated from separate parts that are inseparably moulded or welded or glued together.

In embodiments, the cartridge includes cartridge connection elements for mechanically attaching the cartridge to an outlet and securing the cartridge.

In particular, these connection elements can connect the cartridge to an outlet without the use of further elements that are not part of the cartridge or outlet required to hold them together.

In summary, the cartridge can include the connection elements, spray shaper and skirt as a single part that is, fabricated in one piece or fabricated from separate parts that are inseparably moulded or welded or glued together.

In embodiments, the connection elements include a thread.

The thread can be an external thread or an internal thread, with the corresponding thread of the outlet being an internal thread or external thread, respectively.

In other embodiments, the cartridge is designed to be welded or glued to the outlet.

The cartridge can be held by the skirt and screwed into an outlet. In order to facilitate this, the skirt can include elements for increasing friction on the outer surface of the skirt, such as a knurling, ribs, a polyhedral cross section, etc.

In embodiments, the nozzles are shaped in a nozzle set body of the cartridge. In other embodiments, the nozzles are part of separate nozzle inserts that are inserted in the nozzle set body.

In embodiments, each nozzle inlet is arranged in a corresponding outer surface of the nozzle set body, wherein the outer surface is essentially planar and at a right angle to the longitudinal axis of the respective nozzle.

In embodiments, a region near each nozzle inlet is free from diversion or flow redirecting elements that are arranged to homogenise and even out the flow, thereby causing it to lose energy.

In embodiments, at least the spray shaper and the nozzles include surfaces with a roughness Ra that is smaller than 0.8 micrometres, corresponding to ISO Roughness Grade N6, in particular smaller than 0.2 micrometres, corresponding to ISO Roughness Grade N4.

This improves the flow of the liquid through the nozzles and its reflection within the spray shaper, reducing loss of energy in the flow.

The roughness parameter Ra is the arithmetic average value of a roughness profile determined from deviations about its centre line.

In embodiments, the nozzles are manufactured as part of a moulding process by which a cartridge or a nozzle insert is shaped, for example, by injection moulding. The moulding process can create the cartridge or nozzle insert from a metal alloy, such as bronze, or a plastic material, such as POM (Polyoxymethylene), ABS (Acrylonitrile butadiene styrene), PA (Polyamide). In embodiments, the nozzles are manufactured by machining the nozzles in the cartridge, i.e., in its nozzle set body, wherein the cartridge can first be manufactured by a moulding process. Such machining can be drilling or electrical discharge machining or cutting, in particular laser cutting. In all cases, the nozzle outlets can be machined by a chamfering or deburring operation.

In embodiments, the nozzles each have an asymmetrical cross section, with a narrower part of the cross section being closer to a bisecting line of the longitudinal axes of the nozzles, and a broader part of the cross section being further away from the bisecting line.

The bisecting line of the longitudinal axes of the nozzles typically is coincident with a central longitudinal axis of the cartridge.

Such a shape of the nozzle can focus the kinetic energy in the water jets in the direction of the outlet. This in turn can increase the transfer of energy into the spray, improving the quality of the spray (small droplets).

For such an asymmetrical cross section instead of a circular cross section of the nozzle, the hydraulic diameter is used to characterise nozzle.

In embodiments, the nozzle cross section is a triangle or a triangle with rounded corners.

In embodiments, the following combination of parameters is realised:

Nozzle diameter: 0.8 to 1.5 millimetres.

Length of section of nozzles with constant diameter: at least 2.4 or 4 or 6 or 8 millimetres.

Surface roughness inside the nozzles and/or at the inside of the spray shaper: smaller than 0.8 micrometres, corresponding to ISO Roughness Grade N6, in particular smaller than 0.2 micrometres, corresponding to ISO Roughness Grade N4.

Angle between inner surface of spray shaper and the adjacent surface of the edge protection section: between 35° and 72°, in particular between 55° and 65°.

In embodiments, in addition the following parameter is realised:

Radius of edge at discontinuity or nozzle outlet: less than 1 millimetre, in particular less than 0.8 millimetres, in particular less than 0.5 millimetres, in particular less than 0.3 millimetres.

In embodiments, in addition the following parameter is realised:

Radius of the flow guiding edge at the angle between the inner surface of the spray shaper and the adjacent surface of the edge protection section: less than 1 millimetre, in particular less than 0.8 millimetres, in particular less than 0.5 millimetres, in particular less than 0.3 millimetres.

In embodiments, in addition the following parameter is realised:

Radial distance between the flow guiding edge and a point at which the intermediate surface passes into the front surface: at least three millimetres, at least four millimetres, in particular at least five millimetres.

In embodiments, in addition the following parameter is realised:

Distance between collision point and front surface (approximately equal to the length of the spray shaper): More than 12 or 14 or 17 or 20 millimetres. In particular less than 30 or 25 or 22 millimetres.

The Method for operating the cartridge of one of the preceding claims in a showerhead or tap for dispensing a liquid, in particular water or a water-based mixture, includes the steps of providing the liquid to the cartridge with a pressure in the range of 1 bar to 5 bar, in particular from 1 bar to 3 bar, and more particular, from 1.5 bar to 3 bar;

guiding the liquid through a pair of nozzles with a flow rate between 2 litres per minute and 3 litres per minute, in particular with 2.5 litres per minute, In embodiments, two or three cartridges are combined with a single outlet. The total flow rate of such an outlet is the sum of flow rates of the cartridges. For example, with three cartridges, the total flow rate can be up to 6 or 7 or 8 litres per minute.

In embodiments, a velocity of the liquid in each of the nozzles is larger than 10 metres per second or 20 metres per second or 30 metres per second.

In embodiments, a velocity of the liquid in the nozzles is larger than 10 metres per second or 20 metres per second or 30 metres per second. Typically the velocity is lower than 70 metres per second or 60 metres per second or 50 metres per second.

The water nozzle insert for use in a cartridge as described herein, comprises, for example. a nozzle, wherein an inner diameter of the nozzle is between 0.8 and 1.5 millimetres, and wherein, a throat of the nozzle, along which the nozzle has a constant diameter, has a second length that is at least three times this inner diameter, and in particular at least 2.4 or at least three millimetres.

The outlet includes a cartridge connection section with outlet connection elements for connecting the outlet to a cartridge, an outlet supply section with an outlet supply connector for connecting the outlet to a liquid supply, such as a hose, the outlet supply section being in liquid communication with the cartridge connection section via a conduit through an outlet body connecting the outlet connection element with the outlet supply connector, wherein the outlet supply connector is designed to secure a cartridge attached to the outlet.

The outlet supply connector is designed to secure the cartridge while being free from any further mechanical elements that are not part of the outlet and the cartridge themselves.

The outlet can be a showerhead or a tap.

In embodiments, the outlet is fabricated in one piece or is fabricated from separate parts that are inseparably moulded or welded or glued together.

In embodiments, the conduit except for an optional filter in the outlet supply section is free from filters, and optionally also free from elements that reverse a flow of liquid in the conduit.

In embodiments, the outlet includes a straight pipe section constituting the outlet body and an angled section constituting the cartridge connection section, the cartridge connection section being arranged for the cartridge to be connected to the outlet at an angle between 60° and 120°, in particular between 80° and 100° and in particular at an angle of 90°.

The straight pipe section can allow for a laminar flow through the outlet, reducing energy losses in the flow. In embodiments, the straight pipe section is a cylindrical pipe with a circular cross section and has constant outer and inner diameters along a length of the pipe section.

The outlet and cartridge thereby can form a compact unit that requires a minimum of elements and of material and thus allows for a very light construction. This makes it easier to handle the outlet, as compared to bulkier outlets.

In embodiments, the cartridge is attached to the outlet by one of a threaded connection or screw joint, a snap joint, a welded joint, an adhesive joint.

In embodiments, the cartridge is shaped to have a groove for hanging the combined outlet and cartridge onto a correspondingly shaped hook or receptacle.

In embodiments, the cartridge includes a magnet for attaching the combined outlet and cartridge to a receptacle.

By having such means for attaching the combined outlet and cartridge as part of the cartridge, it is possible to provide for different modes of attachment by replacing or configuring the cartridge with the chosen element (groove or magnet or both).

The water nozzle inserts, nozzle arrangements, cartridges and outlets described above are preferably applied to a washing device with one or more atomisers designed for operating at a reduced flow, that is, a flow of less than 6l/min or 4l/min or 2l/min per atomiser (in particular, per nozzle set) for an outlet in a shower; and a flow of less than 2l/min or 1l/min or 0.5l/min per atomiser (in particular, per nozzle set) for an outlet in a tap.

The outlet is designed to operate, in combination with such a reduced flow rate, at a typical mains water pressure, that is, a pressure in the range of 1 bar to 5 bar, in particular from 1 bar to 3 bar, and more particular, from 1.5 bar to 3 bar.

BRIEF DESCRIPTION OF THE DRAWINGS

The subject matter of the invention will be explained in more detail in the following text with reference to exemplary embodiments which are illustrated in the attached drawings, which schematically show.

DETAILED DESCRIPTION OF THE INVENTION

In principle, identical or functionally similar parts are provided with the same reference symbols in the figures.

Figure 1:
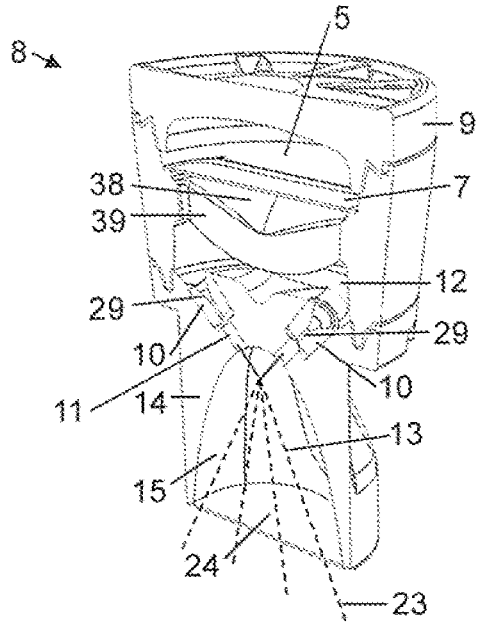
Fig. 1 (prior art)
FIG. 1 a prior art nozzle set unit or cartridge.

FIG. 1 schematically shows a prior art nozzle set unit or cartridge 8. Details thereof are described above. Such a cartridge 8 can be adapted for use with the nozzle inserts 10 described below.

Figure 2:
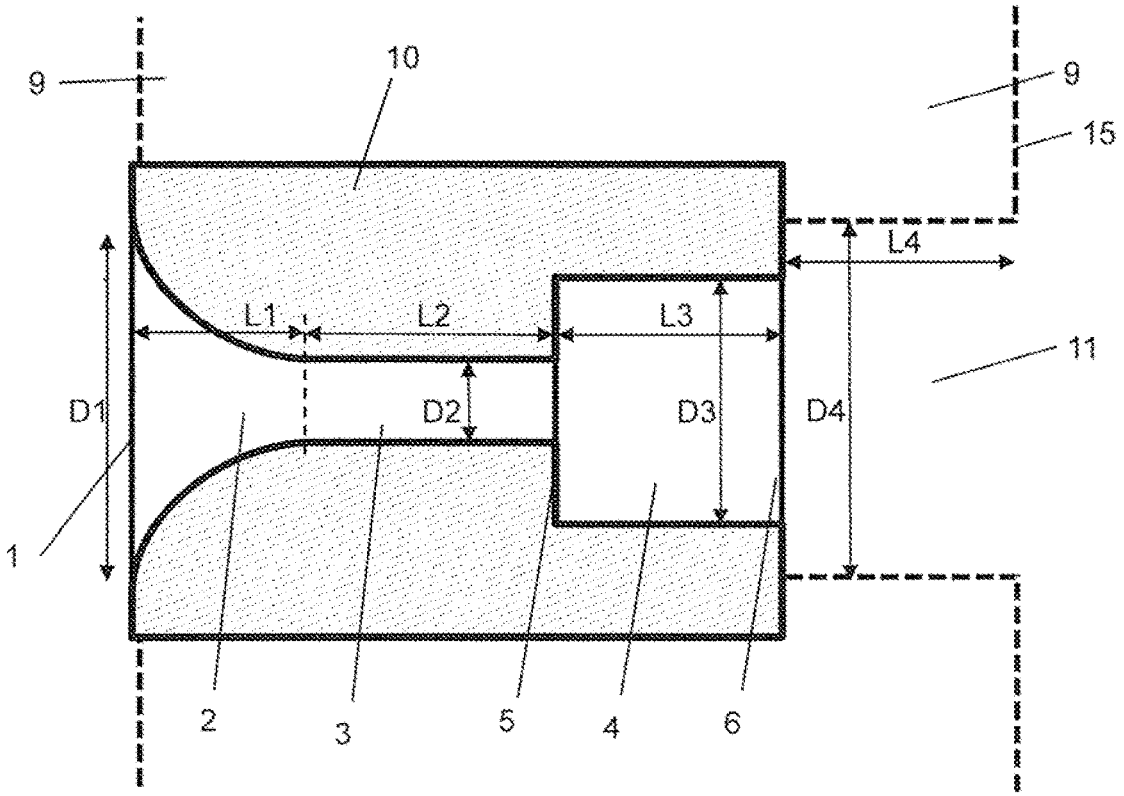
FIG. 2 shows a nozzle insert in a longitudinal cross section.

FIG. 2 schematically shows a nozzle insert 10. It can be arranged or inserted in a nozzle set body 9 as described above. Outlines of a nozzle set body 9 are drawn with dashed lines.

The nozzle insert 10 is arranged in the nozzle set body 9 for a liquid, typically water or a water-based mixture, to flow—in this sequence—from an inlet 1 through a converging section 2, a throat 3, a diverging section 4 and an outlet 6. After exiting the outlet 6, the liquid can flow, as a first jet of liquid, through a recess 11 into a spray shaper. There it can collide with a second jet of liquid and form a spray.

In the converging section 2, a diameter of the nozzle is reduced from a first diameter D1 to a second diameter D2. The surface can exhibit a smooth transition between the converging section 2 and the throat 3.

Typical values of D1 can be two to three times the value of D2.

The converging section 2 has a first length L1.

Typical values of L1 can be one to three times the value of D2.

The throat 3 has a second length L2. In the throat 3, the diameter remains constant, equal to the second diameter D2, for this length.

Typical values of L2 are at least three times the value of D2, in particular at least four times or at least five times the value of D2.

The diameter D2 in the throat 3—generally called the diameter or the hydraulic diameter of the nozzle—corresponds to the diameter of the water jet after exiting the nozzle 12 under ideal conditions, that is, with laminar flow and no diverging of the liquid after exiting the discontinuity 5 and the nozzle outlet 6, e.g. caused by adhesion Typical values of D2 can be between 0.8 millimetres and 1.5 millimetres.

The diverging section 4 has a third length L3. Between the throat 3 and diverging section 4 there is a discontinuity 5. Here, the diameter of the nozzle increases step-wise from the second diameter D2 to a third diameter D3.

Typical values of D3 can be between 1.5 and two or three or four times D2.

Typical values of L3 can be between zero and 1.5 and two or three or four times D2.

The discontinuity 5 can be implemented as a precisely manufactured edge, with a radius of the edge smaller than, for example, two or one or 0.8 or 0.5 or 0.3 millimetres. The edge preferably is manufactured to have no burrs. A burr is a deformation of a material, typically in the form of a raised edge, caused when the material is machined.

The discontinuity 5 can coincide with the nozzle outlet 6. In this case, the diverging section 4 has a length L3 of zero.

The recess 11—which is not part of the nozzle insert 10—has a fourth length L4 and a fourth diameter D4.

Typical values of D4 can be between one or two or three times D3.

Typical values of L4 can be between zero millimetres, and 1.5 and two or three or four times D2 or more.

The nozzle insert 10 can be manufactured from metal or a ceramic material, or from a plastic material different from the material of the nozzle set body 9. The metal can be brass, copper or a copper based alloy.

Figure 3:
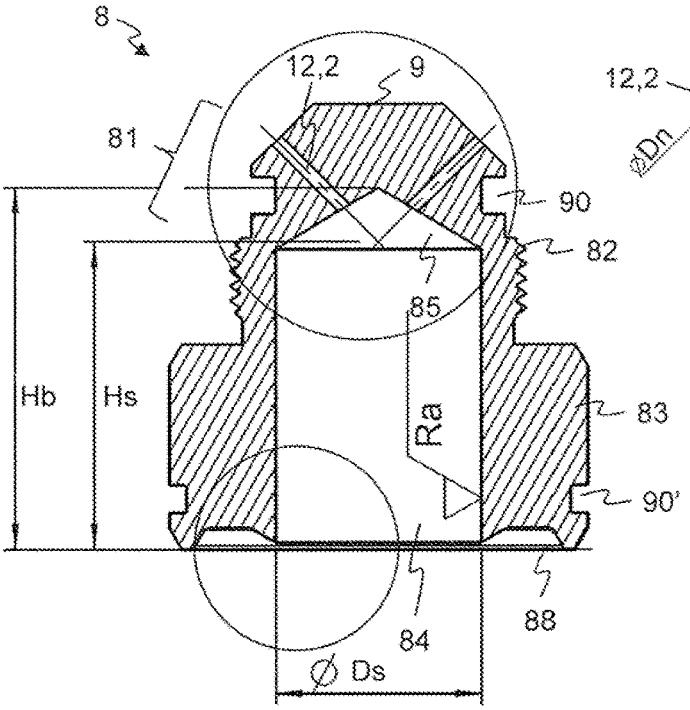
FIG. 3 a cartridge in a longitudinal cross section.
Figure 4:
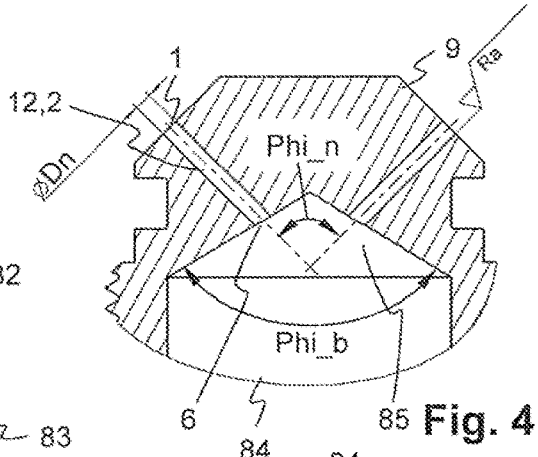
FIGS. 4-6 detail views of FIG. 3.
Figure 5:
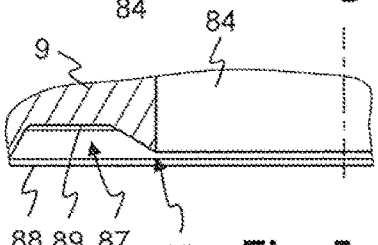
Figure 6:
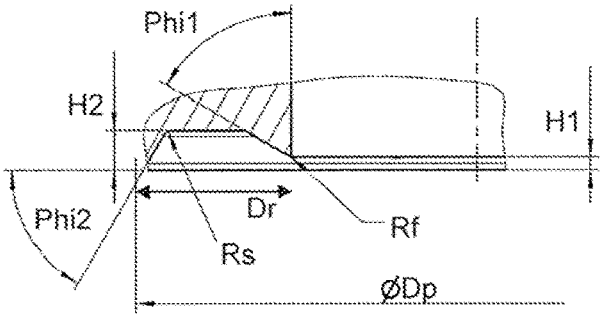

FIG. 3 shows a cartridge in a longitudinal cross section. FIGS. 4-6 show details thereof, with FIGS. 5 and 6 showing the same detail, once with reference numerals and once with parameters indicated.

The cartridge 8 includes the nozzle set body 9, which, in turn, includes the nozzles 12. In this embodiment, the nozzles 12 are shaped in the cartridge body 9 itself. The nozzle set body 9 can be shaped as a truncated cone (as shown in the figures), or as a (complete) cone.

In other embodiments, the nozzles 12 are shaped in nozzle inserts, e.g., as shown in FIG. 2, or differently. Nozzle inserts can be made of ceramic or polymer or metal and are can be inserted in the nozzle set body 9 and secured in an inseparable manner, e.g., a press fit, by gluing or welding or by being arranged in the cartridge by insertion moulding.

Each nozzle 12 extends from an nozzle inlet 1 at the outside of the nozzle set body 9 to a nozzle outlet 6, which can coincide with the discontinuity 5 mentioned above. A point at which the longitudinal axes of the nozzles 12 intersect is the point of collision of liquid jets created by the nozzles 12.

The colliding jets create a spray, which is guided and shaped by a spray shaper 84. The spray shaper 84 can a cylindrical volume and typically is free from obstacles such as sieves or guiding vanes.

At an outer end of the spray shaper 84, it terminates in a circular flow guiding edge 86. Seen in a longitudinal cross section, the flow guiding edge 86 has an acute angle Phi1 relative to an annular edge protection section 87. In the edge protection section 87, the surface of the cartridge 8, starting at the flow guiding edge 86, runs backward, forming an annular recess, and then forward towards a front surface 88 of the cartridge 8. Where the edge protection section 87 runs into the front surface 88, they lie at an angle of 180°−Phi2 to one another. The flow guiding edge 86 is recessed relative to the front surface 88.

The spray shaper 84 is arranged within a skirt 83. The skirt 83 is a ring-like body, integrally shaped with the nozzle set body 9. It can include elements for holding and turning the cartridge 8, e.g. when attaching it to an outlet 7. This can be done by means of a thread 82

There can be a sealing element, not shown, such as an O-ring, arranged to prevent liquid from exiting between an outlet 7 and the cartridge 8. There can be a first O-ring arranged in a first groove 90, between the thread 82 and an upper part of the nozzle set body 9. Alternatively or in addition, there can be a second O-ring arranged in a second groove 90', around the circumference of the skirt 83.

Figure 8:
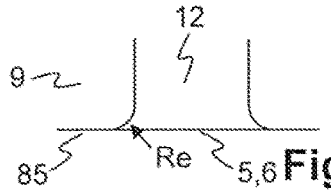
FIGS. 8-10 edges at nozzle outlets in a spray shaper back end.
Figure 9:
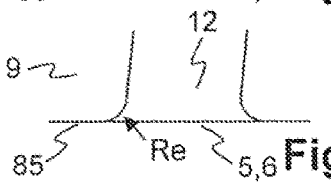
Figure 10:
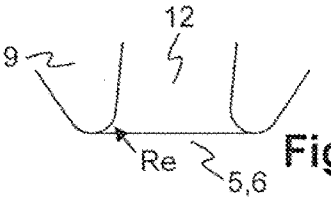

FIGS. 8-10 show edges at nozzle outlets 6 in a spray shaper back end 85, that is, at a transition between the inside surface of the nozzle 12 and the inside surface of the spray shaper 84 in the region of the spray shaper back end 85. An edge forming this transition has a radius Re. This diameter should be small, in order not to cause liquid to adhere to the surface when exiting the nozzle outlet 6 and discontinuity 5. In the Figures, the radius Re is exaggerated relative to the diameter of the nozzle 12.

This effect caused by adhesion can be diminished by giving at least the edge a hydrophobic coating or manufacturing the nozzle set body 9 from a hydrophobic material.

FIG. 8 shows the longitudinal axis of the nozzle 12 being at a right angle to the inner surface of the spray shaper back end 85.

FIG. 9 shows the longitudinal axis of the nozzle 12 being inclined relative to the inner surface of the spray shaper back end 85, i.e. at an angle of less than 90°.

FIG. 10 shows the edge at the end of the nozzle 12 protruding or extending over the inner surface of the spray shaper back end 85. The nozzle 12 is shown as being inclined, but it could also lie at a right angle to the inner surface of the spray shaper back end 85 (not shown).

Typical parameters can be:

Dn—nozzle diameter: 0.8 to 1.5 or 2 millimetres, preferably approximately 1.3 millimetres.

L2—length of section of nozzles 12 with constant diameter: at least three times the value of Dn, in particular at least four times or at least five times the value of Dn. For example, at least 2.4 or 4 or 6 or 8 millimetres.

Phi_n—angle between longitudinal axes of the nozzles: 90°+/−20°

Phi_b—angle between surfaces at which the nozzles exit: between 90° and 130°, in particular at least approximately 120°.

Hs—distance between collision point and front surface 88 (approximately equal to the length of the spray shaper 84): More than 10 or 12 or 14 or 17 or 20 millimetres. In particular less than 30 or 25 or 22 millimetres.

Hb—maximum distance between spray shaper back end 85 and front surface 88: More than 14 or 16 or 18 or 21 or 24 millimetres. In particular less than 33 or 28 or 25 millimetres.

Difference between Hb and Hs: between 2 and 7, in particular between 3 and 5, in particular between 3 and 4 millimetres.

Ds—inner diameter of spray shaper 84: 10 to 18 millimetres, preferably 14 millimetres.

Dp—diameter of edge protection section 87: Ds plus 7 to 15 millimetres, in particular plus 9 to 13, millimetres, in particular plus 11 millimetres.

dR—radial distance between the flow guiding edge 86 and a point at which the intermediate surface 89 passes into the front surface 88: at least three millimetres or at least four millimetres, in particular at least five millimetres. Typically dR=(Dp−Ds)/2.

H1—distance from flow guiding edge 86 to front surface 88: More than 0.3 or 0.5 or 1 millimetre. In particular less than 4 or 3 or 2 millimetres.

H2—maximum distance from recess in edge protection section 87 to front surface 88: More than 1 or 1.5 or 2 millimetres. In particular less than or equal to 5 or 3 or 2 millimetres.

Phi1—angle between inner surface of spray shaper 84 and adjacent surface of edge protection section 87: between 10° and 85°, in particular between 35° and 72°, in particular between 55° and 65°.

Phi2—supplementary angle of the angle between front surface 88 and adjacent surface of edge protection section 87: 60°+/−20°

Rf—radius of the flow guiding edge 86 at the angle between the inner surface of the spray shaper 84 and the adjacent surface of the edge protection section 87: less than 2 millimetres, in particular less than 1 millimetre, in particular less than 0.8 millimetres, in particular less than 0.5 millimetres, in particular less than 0.3 millimetres.

Re—radius of edge at discontinuity 5 or nozzle outlet 6: less than 2 millimetres, in particular less than 1 millimetre, in particular less than 0.8 millimetres, in particular less than 0.5 millimetres, in particular less than 0.3 millimetres.

Surface roughness inside the nozzles and/or at the inside of the spray shaper: smaller than 0.8 micrometres, corresponding to ISO Roughness Grade N6, in particular smaller than 0.2 micrometres, corresponding to ISO Roughness Grade N4.

Typical embodiments exhibit one or more of the above parameter values.

Figure 7:
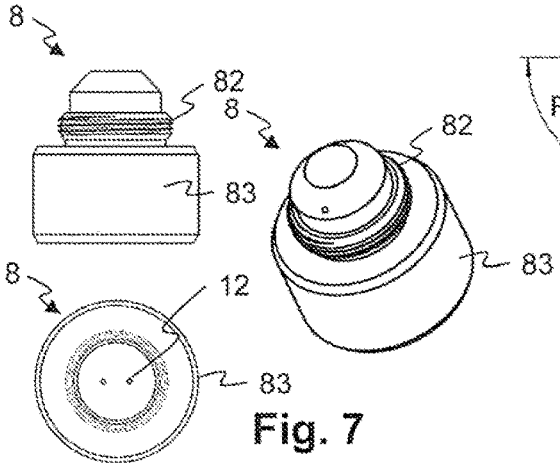
FIG. 7 perspective views of the cartridge.

FIG. 7 shows perspective views of the cartridge 8, in an embodiment without grooves 90, 90'.

Figure 11:
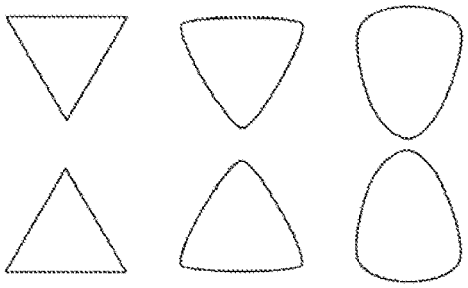
FIG. 11 nozzle cross sections.

FIG. 11 shows nozzle cross sections, corresponding to cross sections of water jets created by the nozzles, and their relative position in the nozzle set body 9. (their size is exaggerated relative to the distance between each pair). For each pair of cross sections, as a result of their relative position, the narrower parts of the liquid jets will meet at a higher point in the spray shaper back end 85, closer to the back end, and the wider parts will meet closer to the front end or spray shaper 84 outlet. This will increase the kinetic energy of the resulting spray in the direction if the front end.

Figure 12:
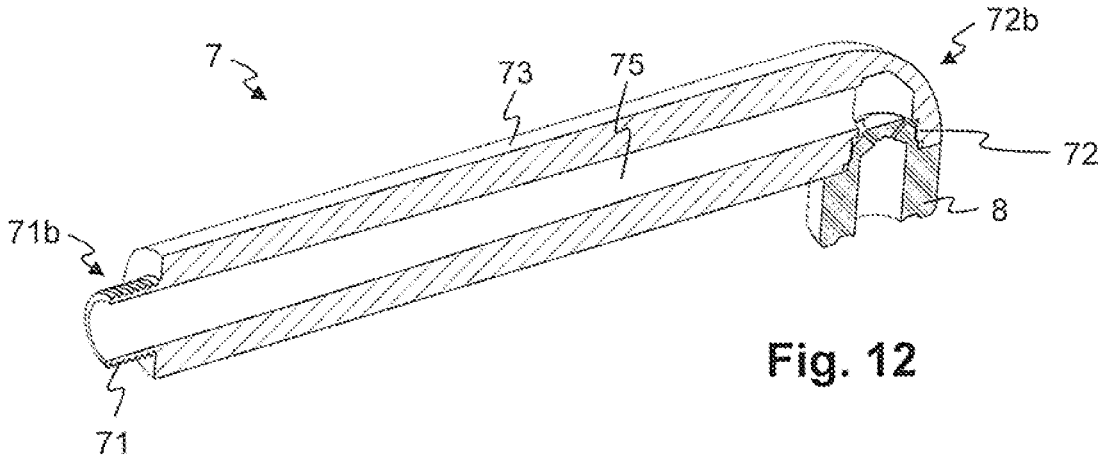
FIG. 12-13 an outlet for use with the cartridge.
Figure 13:
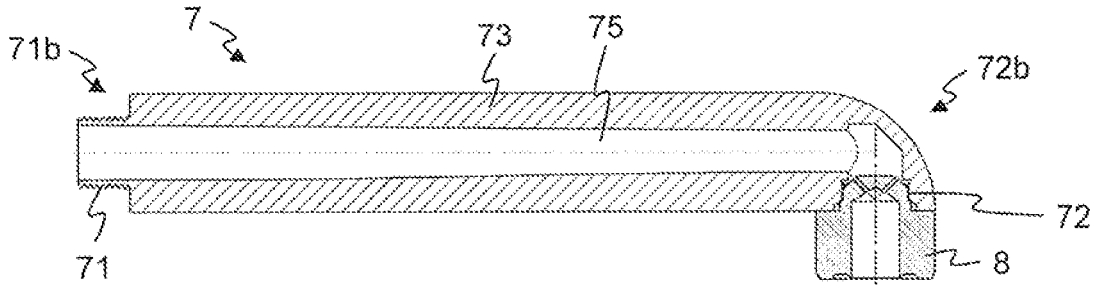

FIGS. 12 and 13 show an outlet 7 for use with a cartridge 8, in particular as described above. The outlet 7 includes an outlet body 73 with a conduit 75 leading from an outlet supply section 71*b* with an outlet supply connector 71 to a cartridge connection section 72*b* with outlet connection elements 72 for connecting the outlet 7 to a cartridge 8.

Figure 14:
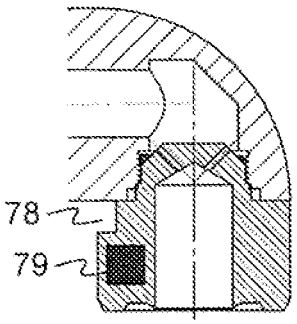
FIG. 14 shows a detail of the outlet shown in FIG. 13.

FIG. 14 shows a detail of FIG. 13, with a groove 78 shaped in the cartridge 8, for hanging the outlet 7 and cartridge 8 onto a correspondingly shaped hook. As an alternative or additional means for attaching the outlet 7 and cartridge 8 to a receptacle, a magnet 79 can be embedded in the cartridge 8, e.g. by insertion moulding.

Typical water pressure ranges for operating the outlet are from 2 bars upwards. Domestic plumbing installations usually are limited to 3.5 or 4 bars. A possible pressure range thus is 1.5 to 3 bar.

While the invention has been described in present embodiments, it is distinctly understood that the invention is not limited thereto, but may be otherwise variously embodied and practised within the scope of the claims.

The invention claimed is:

1. A cartridge for use in a showerhead or tap for dispensing a liquid, comprising a set of at least two nozzles arranged to create colliding jets of the liquid and thereby create a spray of droplets of the liquid, and a spray shaper for guiding the spray, wherein an inner diameter of the nozzles is between 0.8 and 1.5 millimetres, wherein, a throat of each of the nozzles, along which the nozzle has a constant diameter, has a length that is at least three times the inner diameter, and wherein said length is at least 2.4 millimetres, and wherein a radius of an edge forming a transition between the inner surface of the nozzles and the inner surface of the spray shaper is less than two millimetres.

2. The cartridge of claim 1, wherein, at an edge forming a transition between the inner surface of the nozzles and the surface of the spray shaper forms an acute angle.

3. The cartridge of claim 1, wherein all elements acting as the spray shaper are part of the cartridge.

4. The cartridge of claim 1, wherein at least the spray shaper and the nozzles comprise surfaces with a roughness that is smaller than 0.8 micrometres, corresponding to ISO Roughness Grade N6.

5. A method for operating a cartridge according to claim 1 in a showerhead or tap for dispensing a liquid, comprising the steps of:

providing the liquid to the cartridge with a pressure in the range of 1 bar to 5 bar;

guiding the liquid through a pair of nozzles with a flow rate between 2 litres per minute and 3 litres per minute.

6. An outlet, comprising a cartridge connection section with outlet connection elements for connecting the outlet to a cartridge according to claim 1, an outlet supply section with an outlet supply connector for connecting the outlet to a liquid supply, the outlet supply section being in liquid communication with the cartridge connection section via a conduit through an outlet body connecting the outlet connection element with the outlet supply connector, wherein the outlet supply connector is designed to secure a cartridge attached to the outlet.

7. The outlet of claim 6, wherein the outlet comprises a straight pipe section constituting the outlet body and an angled section constituting the cartridge connection section, the cartridge connection section being arranged for the cartridge to be connected to the outlet at an angle between 60° and 120°.

8. The outlet of claim 6, wherein the outlet is either fabricated in one piece or is fabricated from separate parts that are inseparably moulded or welded or glued together.

9. The outlet of claim 6, wherein the conduit, except for an optional filter in the outlet supply section, is free from filters.

10. The cartridge according to claim 1, wherein the cartridge is free from filters.

11. The cartridge according to claim 1, wherein the cartridge is free from elements that reverse a flow of liquid in the cartridge.

12. The cartridge according to claim 1, wherein an angle at which the nozzles exit at an inner surface of the spray shaper is more than 70°.

13. The cartridge according to claim 1, wherein the inner surface of the spray shaper is cylindrical.

14. The cartridge according to claim 1, wherein the cartridge is either fabricated in one piece or is fabricated from separate parts that are inseparably moulded or welded or glued together.

15. The cartridge according to claim 1, wherein the cartridge comprises cartridge connection elements for mechanically attaching the cartridge to an outlet and securing the cartridge.

16. The cartridge according to claim 1, wherein the nozzles each have an asymmetrical cross section, with a narrower part of the cross section being closer to a bisecting line of the longitudinal axes of the nozzles, and a broader part of the cross section being further away from the bisecting line.

17. The cartridge of claim 16, wherein the nozzle cross section is a triangle or a triangle with rounded corners.

18. A water nozzle insert for use with a cartridge according to claim 1, comprising a nozzle, wherein an inner diameter of the nozzle is between 0.8 and 1.5 millimetres, and wherein, a throat of the nozzle, along which the nozzle has a constant diameter, has a length that is at least three times the inner diameter, and at least 2.4 three millimetres.

19. A cartridge for use in a showerhead or tap for dispensing a liquid, comprising a set of at least two nozzles arranged to create colliding jets of the liquid and thereby create a spray of droplets of the liquid, and a spray shaper for guiding the spray, wherein an inner diameter of the nozzles is between 0.8 and 1.5 millimetres, wherein, a throat of each of the nozzles, along which the nozzle has a constant diameter, has a length that is at least three times the inner diameter, and wherein said length is at least 2.4 millimetres, and wherein a distance between a collision point, at which the jets collide, and a front surface of the cartridge is more than three times a distance between nozzle outlets and a point at which the jets collide.

20. A cartridge for use in a showerhead or tap for dispensing a liquid, comprising a set of at least two nozzles arranged to create colliding jets of the liquid and thereby create a spray of droplets of the liquid, and a spray shaper for guiding the spray, wherein an inner diameter of the nozzles is between 0.8 and 1.5 millimetres, wherein, a throat of each of the nozzles, along which the nozzle has a constant diameter, has a length that is at least three times the inner diameter, and wherein said length is at least 2.4 millimetres, and wherein an outer end of the spray shaper opposite to a spray shaper back end, ends with a flow guiding edge forming an acute angle between an inner surface of the spray shaper and an adjacent, intermediate surface.

21. The cartridge of claim 20, wherein a radius of the flow guiding edge is less than two millimetres.

22. The cartridge of claim 20, wherein the intermediate surface, beginning at the flow guiding edge, extends in the direction of the spray shaper back end, and then again in the opposite direction, passing into a front surface of the cartridge.

23. The cartridge of claim 22, wherein a radial distance between the flow guiding edge and a point at which the intermediate surface passes into the front surface is at least three millimetres.

24. The cartridge of claim 20, wherein the front surface is spaced from the spray shaper back end more than the flow guiding edge is.

25. The cartridge of claim 20, wherein the spray shaper, including the flow guiding edge, is integrally shaped as part of a skirt of the cartridge.

26. A cartridge for use in a showerhead or tap for dispensing a liquid, comprising a set of at least two nozzles arranged to create colliding jets of the liquid and thereby create a spray of droplets of the liquid, and a spray shaper for guiding the spray, wherein an inner diameter of the nozzles is between 0.8 and 1.5 millimetres, wherein, a throat of each of the nozzles, along which the nozzle has a constant diameter, has a length that is at least three times the inner diameter, and wherein said length is at least 2.4 millimetres, and wherein a distance between a point at which the jets collide and a spray shaper back end lies between 2 and 7 millimetres.

* * * * *